United States Patent [19]

Reeves et al.

[11] 4,010,419

[45] Mar. 1, 1977

[54] IGNITION ANALYZER TIME BASE

[75] Inventors: George I. Reeves; Donald D. Richards, both of Fullerton, Calif.

[73] Assignee: Beckman Instruments, Inc., Fullerton, Calif.

[22] Filed: Nov. 26, 1975

[21] Appl. No.: 635,743

[52] U.S. Cl. ..... 324/16 S; 328/185

[51] Int. Cl.[2] ..... F02P 17/00

[58] Field of Search ..... 324/16 S, 15, 16 R; 307/228; 328/185

[56] References Cited

UNITED STATES PATENTS

| | | | |
|---|---|---|---|
| 3,603,879 | 9/1971 | Pelta et al. | 324/16 S |
| 3,638,107 | 1/1972 | Pelta et al. | 324/16 S |
| 3,701,954 | 10/1972 | Seminatore et al. | 307/228 X |
| 3,714,499 | 1/1973 | Pelta et al. | 324/16 S X |
| 3,798,965 | 3/1974 | Pelta et al. | 324/16 S X |

*Primary Examiner*—Stanley T. Krawczewicz
*Attorney, Agent, or Firm*—R. J. Steinmeyer; P. R. Harder; D. A. Streck

[57] ABSTRACT

An automobile engine ignition analyzer with engine performance displayed on an oscilloscope. Circuitry for providing timing indicia on the oscilloscope trace in the form of high intensity spots or gaps, with the time intervals between indicia maintained constant as engine speed varies. A pickup for coupling the engine ignition pulse to a pulse shaping circuit which provides an output pulse related in time to the ignition pulse, and an oscillator started by the output pulse and providing a train of pulses at predetermined intervals, typically one millisecond, with the pulse train connected to the oscilloscope beam intensity control for blanking or intensifying the beam as desired.

8 Claims, 4 Drawing Figures

IGNITION ANALYZER TIME BASE

BACKGROUND OF THE INVENTION

This invention relates to analyzers for internal combustion engines and in particular, to a new and improved timing indicator for an engine ignition analyzer.

The ignition analyzers utilizing a cathode ray oscilloscope display are well known and widely used by mechanics in obtaining information regarding the performance of internal combustion engines. Typically the horizontal sweep of the oscilloscope trace is initiated by the engine ignition pulse and the trace is deflected vertically during the sweep as a function of the voltage of the ignition coil. Present day analyzers provide various displays with various inputs for developing a wide range of information useful to the mechanic.

The sweep time of the horizontal axis of the oscilloscope trace is determined by the engine speed and therefore the actual time of a sweep is variable and not readily determined. For certain types of analysis, the mechanic needs to know the actual duration of time during which a spark plug is ionized or firing. With the conventional ignition analyzer, the mechanic can determine whether one spark plug has a longer or shorter ionization time than the other plugs. However in some instances all firing cycles will be uniform but short in duration, such as when the coil is weak, and this condition cannot be determined by comparison of one plug firing cycle with that of another.

In some prior art analyzers, timing lines are permanently provided on the face of the oscilloscope so that when the engine is operated at a predetermined speed, the spacing between the fixed timing lines will represent known time intervals. However this has not been a satisfactory resolution of the problem, since it requires operation of the engine at a predetermined constant speed.

It is an object of the invention to provide new and improved method and apparatus for producing real time indications in an ignition analyzer oscilloscope trace where the sweep time of the trace varies with engine speed. A further object is to provide such method and apparatus wherein the time indications comprise markers in the trace, with the intervals between the markers representing predetermined time periods, typically one millisecond. An additional object is to provide such method and apparatus where the markers may be high intensity spots in the trace or gaps in the trace, as desired. A specific object is to provide such method and apparatus wherein the time interval between the engine ignition pulse and the first marker is the same as the time intervals between succeeding markers.

SUMMARY OF THE INVENTION

The present invention provides method and apparatus for producing real time indications on the oscilloscope trace of an engine ignition analyzer where the trace time varies as a function of engine speed. The engine ignition pulse is detected and provided as an input to a pulse shaping circuit which provides an output synchronization pulse. This synchronization pulse is used to reset a free running oscillator to provide an output pulse train at a predetermined frequency. This pulse train is used to modulate the beam intensity of the oscilloscope, typically through a switching circuit which provides for voltage level control. The electron beam of the oscilloscope may be intensified or blanked for each pulse of the train, with these markers occurring at predetermined time intervals in the oscilloscope trace, regardless of the duration of the trace.

DESCRIPTION OF THE PREFERRED EMBODIMENTS

Figure 1:
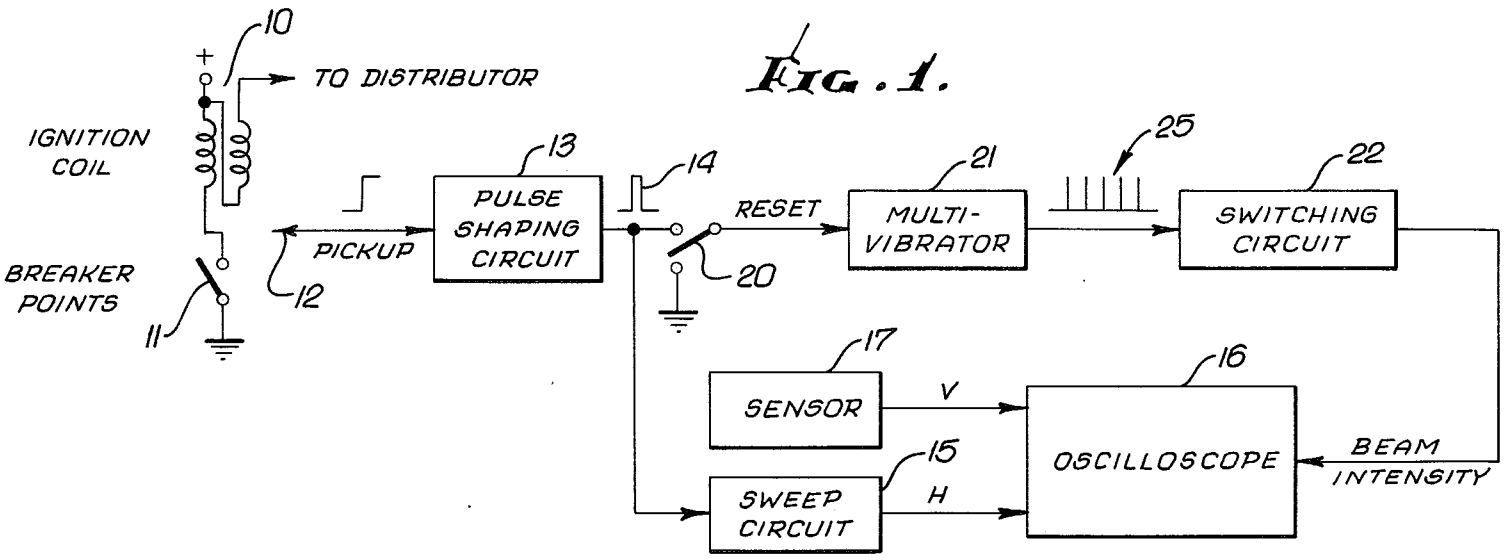
FIG. 1 is an electrical block diagram of an engine ignition analyzer incorporating the presently preferred embodiment of the invention.

FIG. 1 illustrates a conventional internal combustion engine ignition coil 10 and set of breaker points 11. The voltage variations at various points in the ignition system may be detected by a pickup or sensor 12 which may be directly coupled or capacitively coupled or inductively coupled to the ignition system, as desired. When the breaker points open, the high voltage engine ignition pulse (see FIG. 2) is sensed by the pickup 12 and the leading edge of this high voltage pulse is provided as an input to a pulse shaping circuit 13. The output of the pulse shaping circuit is a pulse 14, sometimes referred to as the synchronization pulse, which typically may be used to trigger the horizontal sweep circuit 15 for the oscilloscope 16 of the engine analyzer. The vertical deflection circuitry of the oscilloscope is fed by a sensor 17 which may be positioned at various locations in the ignition system to pick up and display the engine characteristic of interest. The components of the system of FIG. 1 described thus far may be found in various of the presently known engine analyzers.

The analyzer of FIG. 1 also includes a switch 20, an oscillator or multi-vibrator 21, and a switching circuit 22. The switch 20 allows the mechanic to connect the input of the multi-vibrator 21 to circuit ground or to the output of the pulse shaping circuit 13, as desired. When the mechanic wishes to have the timing marks on the oscilloscope trace, he connects the synchronization pulse 14 to the multi-vibrator as a reset or trigger pulse. When the mechanic does not wish to have the timing markers on the oscilloscope, the multi-vibrator input is connected to circuit ground, blocking operation. The oscillator typically is a free running multi-vibrator, triggered by the pulse 14 and providing a train of pulses 25 as an output, with the intervals between pulses being fixed and constant.

The pulse train 25 may be connected directly to the beam intensity control of the oscilloscope 16, or may be connected through the switching circuit 22 which is a conventional circuit providing changes in voltage and power levels.

Figure 3:
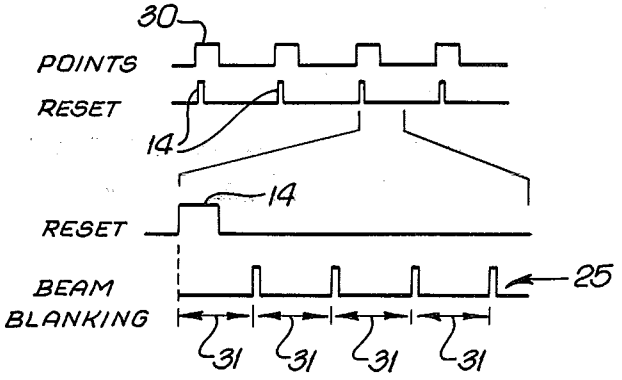
FIG. 3 is a timing diagram illustrating the operation of the circuit of FIG. 1.

The timing of the system is illustrated in FIG. 3. The first row illustrates the opening and closing of the points, with the leading edge of pulse 30 occurring when the points open and with the trailing edge occurring when the points close. The second row illustrates the output of the pulse shaping circuit, with the synchronization or reset pulse 14 being produced by the leading edge of the pulse 30. The third row illustrates an expanded portion of the second row, with the fourth row showing the train of pulses 25 which follow the pulse 14. As stated above, the intervals 31 between the pulses of the train 25 are substantially equal, and typically, the oscillator frequency is selected such that the pulses occur at one millisecond intervals.

Figure 2:
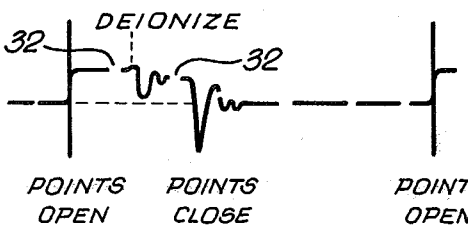
FIG. 2 illustrates a typical oscilloscope trace with the timing markers as gaps in the trace.

Each of the pulses of the pulse train 25 produces a blanking of the electron beam of the oscilloscope, with a corresponding gap 32 in the trace (FIG. 2). In the preferred embodiment of the invention, the time delay between the engine ignition pulse indicated by opening of the points and the first pulse of the train 25 is made equal to the time interval between succeeding pulses of the train so that the interval between the "points open" spike of the display (FIG. 2) and the first of the gaps 32 is the same as the intervals between succeeding gaps. This is readily accomplished by conventional time delay circuitry in the pulse shaping circuit, the multivibrator and/or the switching circuit.

Figure 4:
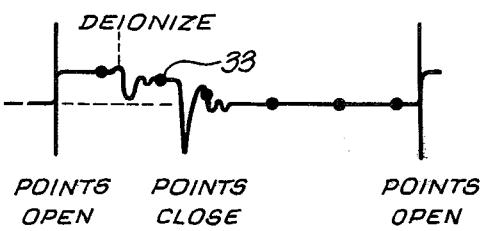
FIG. 4 is a view similar to that of FIG. 2 where the timing markers are high intensity spots in the trace.

The display of FIG. 2 represents a typical ignition coil secondary winding waveform, with the initial spike occurring when the points open and with the later negative spike occurring when the points close. The intermediate peak occurs when the spark plug deionizes. FIG. 4 illustrates a similar display, with the timing marks provided by higher intensity spots 33 rather than by gaps in the trace. With the present invention, the timing marks or indications on the trace appear at fixed time intervals along the trace, regardless of engine speed or trace sweep speed. As the engine speed increases, the indicators will spread apart and when the engine speed decreases, the indicators will move closer together. However the time between the indicators is always a constant. This permits the mechanic to measure the actual time each spark plug is ionized, as well as comparing ionization time of one plug with another.

We claim:

1. In an engine analyzer for analyzing the performance of the ignition system of an internal combustion engine and incorporating an oscilloscope having an electron beam source, means for controlling the intensity of the beam, and means for moving the beam to provide a visible trace related in sweep duration to the duration of events occurring in the ignition system, the improvement to provide indicia of the passage of real time comprising:

means responsive to the ignition system for generating a first electrical pulse indicating the point from which the passage of real time is to be indicated;

oscillator means running at a predetermined frequency to provide an output of second electrical pulses at predetermined intervals of real time and having an input for starting oscillation;

means for connecting said first pulse to said oscillator input; and, means for connecting said second pulses to the beam intensity control of the oscilloscope whereby said second pulses will produce indicia in the trace at real time intervals.

2. An ignition analyzer as defined in claim 1 wherein said first pulse generating means, oscillator means, second pulse generating means and second pulse connecting means incorporate a time delay between said first pulse and the first indicia in the oscilloscope trace of a magnitude substantially the same as said predetermined intervals.

3. An ignition analyzer as defined in claim 1 wherein said indicia comprise spots in the trace of increased intensity.

4. An ignition analyzer as defined in claim 1 wherein said indicia comprise gaps in the trace.

5. A method of indicating real time on an internal combustion engine ignition analyzer having an oscilloscope with the sweep triggered by the engine ignition pulse and with the sweep time varying as a function of engine speed, including the steps of:

detecting the occurrence of an engine ignition pulse;

generating a train of pulses at predetermined time intervals following the engine ignition pulse; and placing an indication in the oscilloscope electron beam at a time corresponding to each pulse of the train of pulses.

6. The method of claim 5 including placing an indication by increasing the beam intensity.

7. The method of claim 5 including placing an indication by blanking the beam.

8. The method of claim 5 including making the time interval between the engine ignition pulse and the first pulse of the train of pulses substantially equal to the time intervals between the pulses of the train.

* * * * *